United States Patent [19]

Kimura

[11] Patent Number: 4,717,923

[45] Date of Patent: Jan. 5, 1988

[54] AUTOMOBILE ANTENNA

[75] Inventor: Misao Kimura, Yokosuka, Japan

[73] Assignee: Harada Kogyo Kabushiki Kaisha, Tokyo, Japan

[21] Appl. No.: 762,924

[22] Filed: Aug. 5, 1985

[30] Foreign Application Priority Data

Oct. 4, 1984 [JP] Japan ..... 59-150483[U]

[51] Int. Cl.[4] ..... H01Q 1/10

[52] U.S. Cl. ..... 343/903; 343/901

[58] Field of Search ..... 343/903, 901, 900, 889

[56] References Cited

U.S. PATENT DOCUMENTS

| | | | |
|---|---|---|---|
| 2,341,401 | 2/1944 | White | 343/903 |
| 2,344,490 | 3/1944 | Brach | 343/903 X |
| 2,537,481 | 1/1951 | Parsons | 343/889 X |
| 2,949,608 | 8/1960 | Fisher | 343/903 |

FOREIGN PATENT DOCUMENTS

| | | | |
|---|---|---|---|
| 50-91527 | 7/1977 | Japan | 343/903 |

*Primary Examiner*—Daniel M. Yasich

*Attorney, Agent, or Firm*—Koda and Androlia

[57] ABSTRACT

An automobile antenna including a cylindrical housing for storing an antenna element, an antenna extension wire for extending and retracting the antenna element, cables connected to the antenna element at one end and the other end to communication equipment, and a cable chamber for storing therein a part of the cables. The cable chamber includes a wind-up shaft with a spiral fin formed around the outer circumference thereof, and the cables are wound along the spiral fin such that the coil diameter of the cables around the wind-up shaft is reduced and increased along the spiral fin upon the extension and retraction operations of the antenna element.

1 Claim, 7 Drawing Figures

AUTOMOBILE ANTENNA

BACKGROUND OF THE INVENTION

1. Field of the Invention

The present invention relates to an antenna and more particularly to an automobile antenna with a housing for storing a cable connecting an antenna element and communication equipment.

2. Prior Art

Generally, an automobile antenna for receiving broadcast waves of radio, etc. has a structure as described below. A cylindrical housing to store an antenna element is installed inside the automobile body and a rod antenna element is stored in this housing in such a manner as to be optionally inserted into or pulled out from the outside of the vehicle body. One end of the cable, such as a coaxial feeder cable, is connected to a conductive feeding tube, provided on the foregoing cylindrical antenna housing, so as to freely and slidably come into contact with the above-mentioned antenna element. The other end of the coaxial feeder cable is connected to communication equipment such as receiver set.

However, when the antenna constructed as described above is used for sending and receiving radio waves of a relatively high frequency such as wireless telephones in automobiles, the loss at the contact area between the antenna element and the conducting tube becomes great and stable transmission and reception cannot be achieved. Accordingly, it becomes necessary to directly connect one end of the coaxial feeder cable to the antenna element and the other end to the transceiver set through a fixing mount.

However, there is a problem in how to house the coaxial feeder cable which must be extended and contracted during extension/retraction of the antenna element. Various proposals have been made, but generally they require complicated structures which make it difficult to keep manufacturing costs low. Besides, their performance is not reliable. For example, Japanese Patent Application Laid-Open No. 1982-106303 discloses a car antenna extending/retracting mechanism wherein the car antenna has a motor-drive cable drum on which a cable winding portion is provided. The coaxial feeder cable is wound up on this winding portion and then led into a control room. Inside this control room, the coaxial feeder cable is wound around a cylinder in a neat spiral or scroll form so as to be stored.

However, in the above antenna mechanism, a control room and cable drum with a specific structure must be provided in relation to each other. As a result, the structure becomes very complicated, making it difficult to manufacture at a low cost. Furthermore, in the foregoing mechanism, while the coaxial feeder is orderly wound, if there is a dimensional error or operational variance, etc., excessive force is applied to the coaxial feeder cable, causing damage to it.

SUMMARY OF THE INVENTION

In light of the defects of conventional automobile antennas, an object of the present invention is to provide an automobile antenna equipped with a cable housing mechanism.

Another object of the present invention is to provide an automobile antenna which is, even when there is a dimensional error or operational variance, etc., free of the possible risk of imposing excessive force on the cable, such as coaxial feeder cable, and also free from causing twisting of the cable, thereby eliminating the chances of damaging the cable.

Still another object of the present invention is to provide a car antenna equipped with a cable housing mechanism that is small in size, lightweight and can be manufacturing at a low cost.

Still a further object of the present invention is to provide an automobile antenna equipped with a cable housing mechanism whose performance is highly reliable.

In keeping with the principles of the present invention, the above objects are accomplished by a unique structure for an automobile antenna including a cable chamber which further includes a wind-up shaft for cables. The wind-up shaft is provided with a spiral fin around the outer circumferential surface of the wind-up shaft and forms a deep spiral groove along the outer circumferential surface of it so that the shaft has enough space for winding the cables around the outer circumference. The cable, particularly the intermediate portion defined by being connected to the antenna element at one end and to the chamber wall at the other end, is wound along the spiral fin on the wind-up shaft such that the diameter of the cable when wound is reduced when the antenna is extended and increased when the the antenna is retracted.

DETAILED DESCRIPTION OF THE INVENTION

Figure 1:
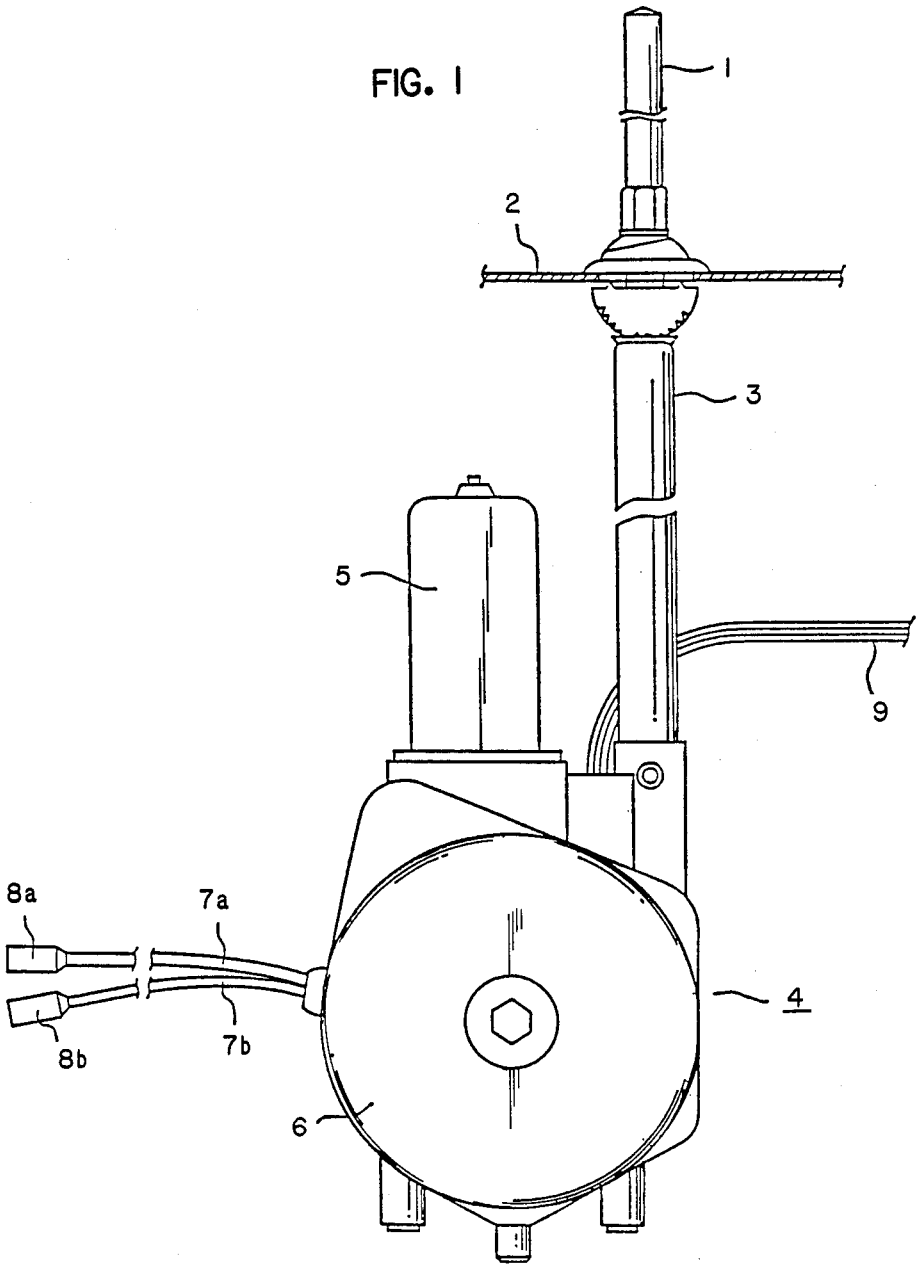
FIG. 1 is a front view showing the exterior of the automobile antenna of the present invention.

In FIG. 1 the numeral 1 is an antenna element used for radio telephones, etc. This antenna element 1 is encased in a cylindrical housing 3 such that it is freely inserted and pulled out of the housing. The antenna housing 3 is installed inside the body of the vehicle 2. An antenna drive mechanism 4 is connected to the base end of the cylindrical housing 3.

The antenna drive mechanism 4 extends and retracts the antenna element 1 by feeding and withdrawing a wire by a wire feeding/withdrawing mechanism which is operated by a motor 5. A cable chamber 6, which will be described later, is attached to the foregoing antenna drive mechanism 4. From the cable chamber 6 one end of a pair of cables such as coaxial feeder cables 7*a* and 7*b* are fed outside. The other end of the coaxial feeder cables 7*a* and 7*b* are connected to connectors 8*a* and 8*b* which connect the coaxial feeder cables to communication equipment that is a transmission/reception apparatus, etc. (not shown) The numeral 9 is a control wire for performing drive control of the motor 5, etc.

Figure 2:
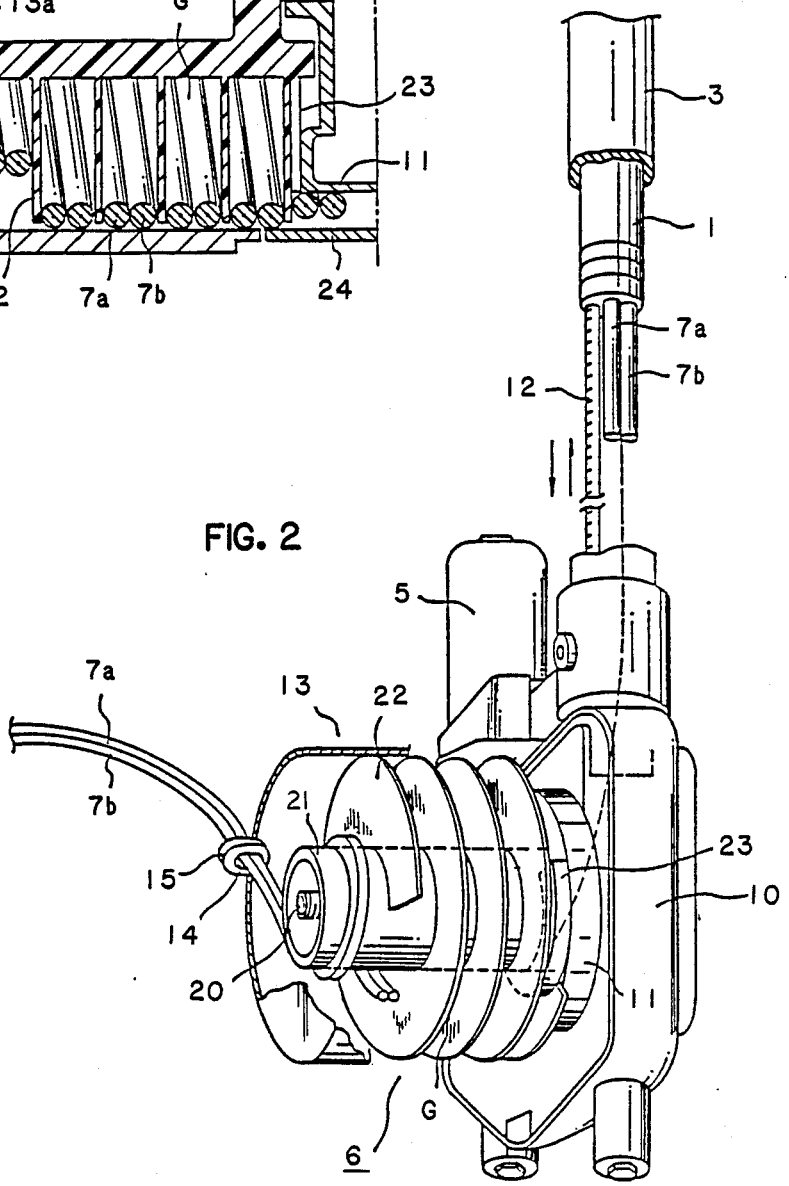
FIG. 2 is a partially broken perspective view showing the structure of the essential portion thereof.

FIG. 2 is a partially broken perspective view of the structure of the essential portion, focusing on the cable chamber 6, of the automobile antenna. In FIG. 2, the numeral 10 is the base of the driving mechanism 4. A rotary drum 11 for winding a wire is attached in a freely rotatable manner to the base 10. The rotary drum 11 functions to wind and unwind an antenna extension wire 12.

The antenna extension wire 12 is made of, for example, hard synthetic resin, and its circumferential surface is toothed into a rack-like form. One end of the antenna extension wire 12 is connected and fixed to the base end of the antenna element 1 which is inserted into the cylindrical housing 3. The other end of the antenna extension wire 12 is taken into the rotary drum 11 through the wire feeding mechanism (not shown) which is disposed inside the base 10 and driven to rotate via the motor 5. When the motor 5 rotates the antenna extension wire 12 is moved in the directions indicated by the arrows in the Figure thereby extending or retracting the antenna element 1.

One end of each of the coaxial feeder cables *7a* and *7b* are connected to the base end of the antenna element 1, and are also respectively connected to specified antenna components provided inside of the antenna element 1. The other end of each of the coaxial feeder cables *7a* and *7b* are respectively fed into the base 10 from the bottom of the cylindrical housing 3 and further led outside of the cover 13 through a cable outlet port 14 through the cable chamber 6. The cable outlet 14 is provided in the cover 13 of the cable chamber 6. The coaxial feeder cables *7a* and *7b*, which pass through the cable outlet portion 14, are fixed to the cover 13 by means of a rubber bushing 15. In other words, those portion of the cable fixed to the cover as mentioned above are respectively referred to in this invention as the "fixed portion".

The cable chamber 6 is fitted on a main shaft 20 and the base end of the main shaft 20 is fixed to the base 10. The cable chamber 6 includes a wind-up shaft 21, a spiral fin 22, a guide piece 23, and a guide ring 24 (shown in FIG. 3). The wind-up shaft 21 is coaxially disposed on the rotary drum 11. The spiral fin 22 is formed on the wind-up shaft 21 so as to stick out from the outer circumferential surface of the wind-up shaft 21.

Figure 3:
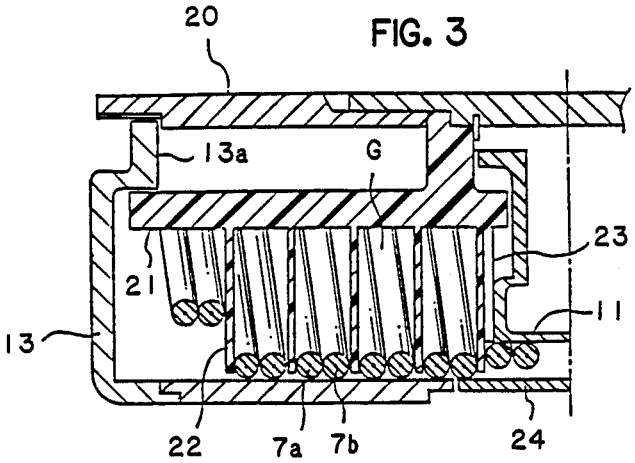
FIG. 3 is a sectional view showing the lower half of a housing unit.

FIG. 3 is a sectional view showing the cable chamber 6 with the lower half section cut away. As seen in FIG. 3, the wind-up shaft 21 is fixed at its end base 21*a* to the main shaft 20. The open front end 22*b* of the wind-up shaft 21 is engaged with a recessed portion 13*a* of the cover 13. In this way, the wind-up shaft 21 is coaxially held to the main shaft 20.

The spiral fin 22 is formed as an integral part of the wind-up shaft 21. The distance between the fin and the height of the fin is determined so that a deep spiral groove G, which is deeper than a diameter of the feeder cables *7a* and *7b* and is wider than twice the diameter of the coaxial feeder cables *7a* and *7b* so that the coaxial feeder cables may be taken up and wound side by side in the deep spiral groove.

Further, the guide ring 24 is disposed to encircle the outer circumferential surfaces of the rotary drum 11 and the guide piece 23 with a given space left in between. The guide ring 24 functions to control the coaxial feed cables *7a* and *7b* so that they are prevented from sticking out.

Figure 4A:
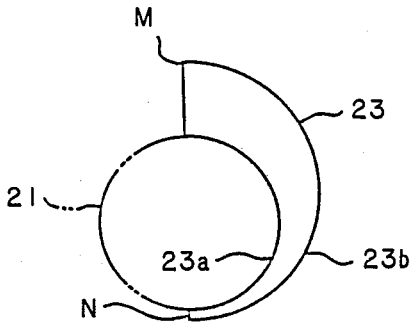
FIGS. 4(*a*) and 4(*b*) are a front view and a side view showing the structure of a guide piece.
Figure 4B:
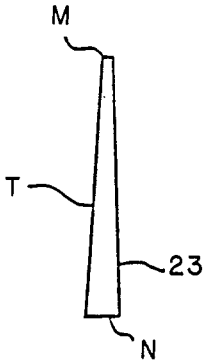

FIGS. 4(*a*) and 4(*b*) are a front view and a side view of the guide piece 23. As seen in the Figures, the guide piece 23 has a circular arc 23*a* at its inner circumferential portion, and this circular arc 23*a* engages with the outer circumferential surface of the the wind-up shaft 21. The outer circumference of the guide piece 23 is formed into a circular arc 23*b* that is eccentric relative to the inner circular arc 23*a*. The outer circular arc 23*b* of the guide piece 23 is formed so that its one end M on the side closer to a liaison hole formed between the base 10 and the cylindrical housing 3 gradually increases the distance from the outer circumferential surface of the wind-up shaft 21 until it lies flush in one plane with the outer circumferential surface of the rotary drum 11, while on the other hand, the other end area N located on the side farther from the liaison hole of the base 10 becomes gradually closer to the outer circumferential surface of the wind-up shaft 21. The guide piece 23 is, as shown in FIG. 4(*b*), thin at one end M and thick at the other end N. In other words, the guide piece 23 has a tapered surface T matching the slope of the spiral fin 22.

Figure 5:
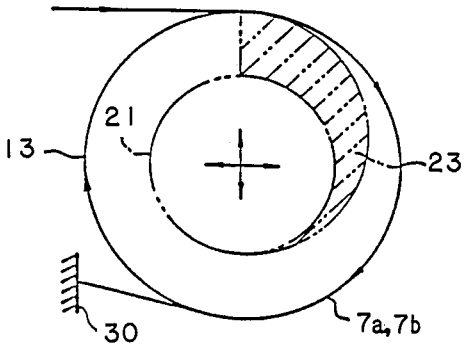
FIGS. 5 and 6 are diagrams illustrating the cable winding operation.

In operation, when the antenna extension wire is wound up by the motor 5 such that the antenna element 1 is pulled into the cylindrical housing 3 to be retracted, the coaxial feeder cables *7a* and *7b* in the cylindrical housing 3 are led in toward the base 10 and led into and wound up in the spiral groove G by the guide piece 23 and the guide ring 24. As a result, the diameters of the coils of the coaxial feeder cables *7a* and *7b* which extend from the fixed portion 30 (shown in FIG. 5) and which have been led and wound in the deep spiral groove G of the cable chamber 6 increase along the wind-up shaft 21 until they come close to the inner circumferential surface of the cover 13. FIG. 5 shows the cable wound in such a manner.

Figure 6:
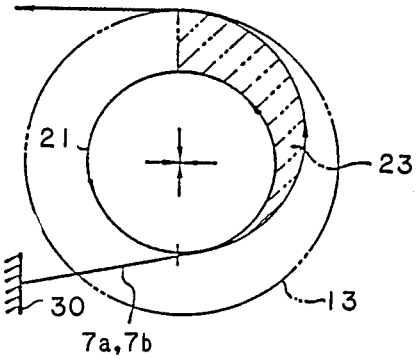

On the other hand, when, by means of the motor 5, the antenna element 1 is extended by being pushed out of the cylindrical housing 3 by the antenna extension wire 12, the portions of the coaxial feeder cables *7a* and *7b* which are close to the base 10 are led into the cylindrical housing 3. Thus, the diameters of the coils of the coaxial feeder cables *7a* and *7b*, which extend from the fixed portion 30 (shown in FIG. 6) and which are held in and wound up within the deep spiral groove G of the wind-up shaft 21 in the cable chamber 6, decrease along the wind-up shaft 21, until they come close to the outer circumferential surface of the wind-up shaft 21. FIG. 6 shows the cable unwound in such a manner.

In the above operation, the coaxial feeder cables *7a* and *7b* are free to move in the deep spiral groove G in the radial direction. Therefore, even if there is an error in the dimensions of the cable chamber 6 or there is an inconsistency in length of the coaxial feeder cables *7a* and *7b* undue stress is not applied to the coaxial feeder cables *7a* and *7b*. Also, the coaxial feeder cables *7a* and *7b* do not twist, and operation of the antenna is carried out stably and smoothly.

The present invention is not limited to the embodiments described above. Various modifications can be obtained by those skilled in the art without departing from the scope of the concepts of the present invention which are claimed in the following claim.

As described in detail above, the unique feature of the present invention lies in the structure of the cable chamber 6 which stores the intermediate portions of the coaxial feeder cables. The intermediate portions are the sections of the coaxial feeder cables located between the cylindrical housing 3 and the fixed portion on the cable chamber cover 13. The cable chamber 6 is provided with a spiral fin 22 formed around the outer circumferential surface of the wind-up shaft 21 which is located in the chamber, and by means of this spiral fin 22, deep spiral grooves are formed for storing the coaxial feeder cables. The cables are wound and unwound on the wind-up shaft 21 such that the coil diameter of the coaxial feeder cables increases when the cables are wound and decreases when unwound in accordance with the retraction and extension of the antenna element.

Accordingly, variations in the lengths of the coaxial cables are accomplished via the increase or decrease in the diameters of the coaxial feeder cables in the deep spiral grooves. In this case, the coaxial feeder cables are free to move in the deep spiral grooves in the radial direction with no dimensional restrictions imposed on them. Therefore, dimensional errors in the size of the cable chamber or differences in the operation lengths of the coaxial feeder cables do not cause undue stress or force to be applied to the cables. Also, the cables never twist. Furthermore, the cable chamber is simple in structure, only requiring the spiral fin to form the grooves on the outer circumferential surface of the shaft body. As a result, an automobile antenna equipped with a coaxial feeder cable chamber which is simple in structure, small in size, lightweight and inexpensive to manufacture can be produced in accordance with the teachings of the present invention.

I claim:

1. An automobile antenna comprising:

a cylindrical housing for storing an antenna element;

an antenna extension wire for extending and retracting the antenna element through the cylindrical housing by a motor;

a pair of feeder cables connected at one end to the antenna element and at the other to a communication equipment; and a cable chamber non-rotatably coupled to the cylindrical housing for storing therein intermediate portions of the pair of feeder cables, the cable chamber comprising:

a wind-up shaft non-rotatably coupled to the cylindrical housing; and a spiral fin of a plurality of turns extending radially from and formed coaxially around an outer circumference of the wind-up shaft defining with the wind-up shaft a deep spiral groove for locating the pair of feeder cables therein, said deep spiral groove being deeper than a diameter of one of said pair of feeder cables and a cable chamber cover coaxially surrounding and covering the entire spiral fin and the wind-up shaft whereon one end of the intermediate portions of the pair of feeder cables are fixed thereto whereby diameters of coils of the pair of feeder cables around the wind-up shaft in the deep spiral groove reduced or increased along the spiral fin on the wind-up shaft respectively during extension or retraction of the antenna element.

* * * * *